United States Patent [19]

Masuda

[11] 4,116,084

[45] Sep. 26, 1978

[54] MOVABLE TOY HAVING GEAR DISENGAGING MECHANISM AND GEAR CHANGING MECHANISM

[75] Inventor: Akio Masuda, Tokyo, Japan

[73] Assignee: Alps Shoji Co., Ltd., Tokyo, Japan

[21] Appl. No.: 811,861

[22] Filed: Jun. 30, 1977

[30] Foreign Application Priority Data

Dec. 27, 1976 [JP] Japan ..... 52-177106
Apr. 6, 1977 [JP] Japan ..... 52-43315

[51] Int. Cl.[2] ..... F16H 3/22; F16H 1/02; A63H 29/20

[52] U.S. Cl. ..... 74/342; 46/209; 74/412 R

[58] Field of Search ..... 74/405, 421 R, 412 R, 74/342, 384, 344; 46/206, 207, 209

[56] References Cited

U.S. PATENT DOCUMENTS

| | | | |
|---|---|---|---|
| 1,087,277 | 2/1914 | Clark | 46/209 X |
| 2,257,064 | 9/1941 | Müller | 46/212 X |
| 2,536,395 | 1/1951 | Saunders, Jr. | 74/205 |
| 2,625,831 | 1/1953 | Saunders, Jr. | 74/342 |
| 3,350,953 | 11/1967 | Stewart | 74/412 R |
| 3,546,809 | 12/1970 | Nielsen | 46/206 |
| 4,059,918 | 11/1977 | Matsushiro | 46/209 |

*Primary Examiner*—Leonard H. Gerin
*Attorney, Agent, or Firm*—Brisebois & Kruger

[57] ABSTRACT

A gear disengaging mechanism for use in a movable toy which mechanism disengages automatically the engagement between a first gear receiving the rotation from a driving section and a second gear being pushed by a spring. The bearing hole for the shaft of the second gear is a slot in which one end portion of the shaft is moved. The shaft that is moved in the bearing hole is urged toward one side by the spring member one end of which is fixed to a frame body, thus gears are releasably engaged together. When a gear on the driven side is forcibly stopped, the gear shaft is shifted along the bearing hole against the force of the spring member and the engagement of gears is released. Further, between the driving section and the driven section is disposed a gear changing mechanism with which the gear change is carried out by moving a gear shaft in its axial direction.

7 Claims, 7 Drawing Figures

MOVABLE TOY HAVING GEAR DISENGAGING MECHANISM AND GEAR CHANGING MECHANISM

BACKGROUND OF THE INVENTION

This invention relates to a movable toy. More particularly, the invention relates to a movable toy which is provided with an automatic gear disengaging mechanism and a gear changing mechanism. When the rotation of wheels is abruptly stopped, the rotatory power transmitted from the driving section such as an electric motor, a spring or a fly-wheel, is automatically released by the gear disengaging mechanism.

In the prior art devices of this kind, for example, in the mechanism as disclosed in Japanese Utility Model Publication No. Sho. 42-21216 (1967), the engagement and disengagement of gears are attained by moving up or down the machine frame of a toy car. More particularly, a wheel driving shaft is inserted through a pair of vertical slots of a gear box. The gear attached to the wheel driving shaft is utilized as the rotatory power source for a fly-wheel when the machine frame suspended by springs is pushed down. Accordingly, if the machine frame is raised up, the toy car can not be driven. When the compression to the springs is released, the machine frame is lifted by the springs and the transmission between the wheels and the fly-wheel is disengaged. Therefore, as the measure to connect the rotation of fly-wheel to the outer wheels when the car is allowed to run, a laterally movable intermediate shaft is interposed between the fly-wheel in the driving section and the wheels in the driven section. Accordingly, even when the wheels are pressed to and rubbed with the floor so as to energize the fly-wheel and to prepare the running, the toy car is not driven. In order to start the running of the toy car, the second operation to slide the intermediate shaft into the space between the wheel shaft and the fly-wheel shaft is required.

Further, when the running toy car is forcibly stopped by pressing it to the floor, another disadvantage is caused to occur in that the teeth of gears in the driving transmission system are often broken by the rotatory power of the fly-wheel.

SUMMARY OF THE INVENTION

It is, therefore, the primary object of the present invention to provide a movable toy which has a fly-wheel or the like as a rotatory power source and is provided with a main driving section having an automatic gear disengaging mechanism. When strong resisting force is applied to the wheels in the driven section, the gear disengaging mechanism automatically releases the engagement of gears of the driven section from those of the driving section in the power transmission system.

Another object of the present invention is to provide a durable movable toy in which the breaking of gear teeth is eliminated by making possible the idle running of the energized fly-wheel.

A further object of the present invention is to provide a movable toy in which a gear changing mechanism is installed between the driving section having an automatic gear disengaging mechanism and the driven section in the transmission system.

Still a further object of the present invention is to provide a movable toy in which the operation of the gear changing mechanism can be easily and reliably performed from the outside of the toy body.

Other objects and features of the present invention will become more apparent from the following description on typical embodiments with reference to the accompanying drawings.

Incidentally, the following description are given for the purpose of illustrating the present invention and by no means for restricting the scope of the invention.

BRIEF DESCRIPTION OF THE INVENTION

In the accompanying drawings.

DETAILED DESCRIPTION OF PREFERRED EMBODIMENTS

The construction, functions and effects of the present invention will now be described in detail with regard to preferred embodiments.

Figure 1:
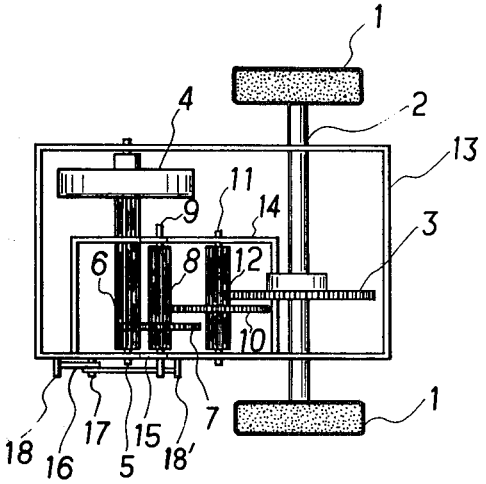
FIG. 1 is a plan view of an embodiment of the gear disengaging mechanism of the present invention.
Figure 2:
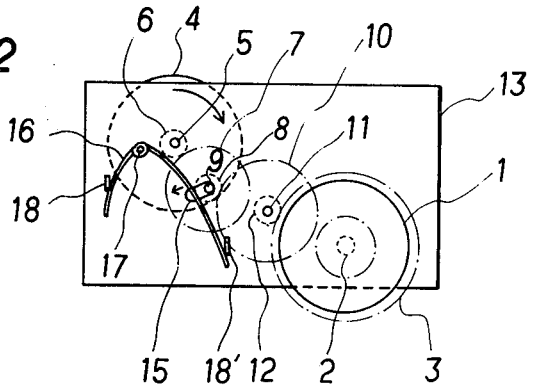
FIG. 2 is a side view of the same.

A first embodiment is described in the first place with reference to the drawings. FIG. 1 is a plan view and FIG. 2 is a side elevation of the embodiment, in which the main portion of the gear train of the gear disengaging mechanism according to the present invention is shown.

The reference numeral 1 indicates wheels that are attached to the chassis of a movable toy, the reference numeral 2 indicates a driving shaft for the wheels 1, and the reference numeral 3 denotes a driving gear which is attached to the driving shaft 2. The reference numeral 4 indicates a fly-wheel which is fastened to a wheel shaft 5 having an energizing gear 6. The reference numeral 7 denotes another gear which is in engagement with the energizing gear 6 and is attached to an idle gear shaft 9 together with an idle gear 8 to be rotated together. The reference numeral 10 indicates a gear which is attached to a gear shaft 11 and meshes with the idle gear 8. A gear 12 is also attached to the gear shaft 11 to be engaged with the driving gear 3.

The reference numeral 13 denotes a gear box which supports therein the wheel shaft 5, idle gear shaft 9, other gear shaft 11 and driving shaft 2. Further, the reference numeral 14 denotes an inner gear box which is installed in the gear box 13 and carries each one side end of the idle gear shaft 9 and other gear shaft 11. With the provision of this inner gear box 14, the lengths of the gear shafts 9 and 11 can be reduced so as to make the inside of the gear box 13 in good order. Incidentally, the gear box 13 and the inner gear box 14 are vertically fastened to the chassis.

The reference numeral 15 indicates bearing hole for the idle gear shaft 9. This bearing hole 15 is made in the form of a slot so as to move the idle gear shaft 9 on a part of the circumferences about the bearing portion of the wheel shaft 5. A spring that is indicated by a reference numeral 16 is bent in a U-shape over a projection 17 and both end portions of the spring 16 are fixed to projections 18 and 18', respectively. The spring 16 pushes the idle gear shaft 9 in the direction to the gear shaft 11 and the projection 18' depresses one end of the spring 16 so as to suppress the friction between the spring 16 and the idle gear shaft 9. In the normal state, the idle gear shaft 9 is pushed rearward (toward the wheels 1) by means of the spring 16 so that the idle gear 8 is brought into engagement with the gear 10. Accordingly, when the wheels 1 are rotated in any directions, the rotation is transmitted to the fly-wheel 4 by way of the gear train. After the energization to the fly-wheel 4, the rotation of the wheels 1 as a driven section is continued by the inertia of the fly-wheel 4 as a driving section. This function is just the same as those of ordinary toy cars that are driven by fly-wheels.

In FIG. 2, the above wheels 1 are rotated counterclockwise and the fly-wheel 4 are rotated clockwise in order to move the toy car forward, and it is assumed that the wheels 1 are forcibly stopped.

Since the driving shaft 2 and the gear shaft 11 are supported in the gear box 13 and the inner gear box 14, when the wheels 1 are stopped, the gear 10 is simultaneously stopped. The fly-wheel 4 is, however, turned continuously by its own inertia. The idle gear 8 being in mesh with the gear 10 is stopped by the gear 10, while the gear 7 is pushed forward by the energizing gear 6 rotated clockwise by the fly-wheel 4. Therefore, the idle gear shaft 9 is moved forward in the direction of an arrow within the bearing hole 15 against the force of the spring 16. When the idle gear shaft 9 is separated from the gear shaft 11, the idle gear 8 is released from the gear 10 so that the fly-wheel 4 and the idle gear 8 are still rotated even when the wheels 1 are stopped. Incidentally, the engagement between the energizing gear 6 and the gear 7 is not released because the bearing hole 15 runs on the circumference about the center of the wheel shaft 5.

In order to disengage the gears by shifting the idle gear shaft 9 in the bearing hole 15 against the force of the spring 16, it is necessary to determine the direction of the bearing hole 15 such that the position of the idle gear shaft 9 after the shifting may be always on the outside of the imaginary line connecting the wheels shaft 5 and the gear shaft 11. In other words, the wheel shaft 5, idle gear shaft 9 after the shifting and the gear shaft 11 are so disposed to form a triangle when they are connected, and at the same time, it is necessary that the initial position of the idle gear shaft 9 is set near to the line connecting the wheel shaft 5 and the gear shaft 11 as compared with the position of the idle gear shaft 9 after the shifting. Further, in order to release the engagement between the idle gear 8 and the gear 10 most effectively, the bearing hole 15 is disposed so that the idle gear shaft 9 is shifted on the circumference about the center of the wheel shaft 5, as described above.

Figure 3:
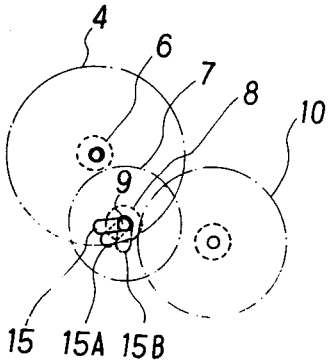
FIG. 3 is a schematic side view showing the disposition of a bearing hole.

Some examples for the disposition of the bearing hole 15 are shown in FIG. 3.

A first example is an arcuate slot-shaped bearing hole 15 which is formed along the circle that is concentric with the wheel shaft 5. In this case, when the gear 10 is abruptly stopped, the gear 8 is disengaged from the gear 10 by the energizing gear 6 and is moved clockwise to the other end of the bearing hole 15 with maintaining the engagement with the energizing gear 6 through the gear 7.

In the second example, the bearing hole 15A is formed at right angles to the imaginary line connecting the wheel shaft 5 and the gear shaft 11. When the rotation of the gear 10 is abruptly stopped in this case, the idle gear shaft 9 is shifted at right angles to the above imaginary line, by means of the energizing gear 6. Accordingly, the engagements of the idle gear 8 with the energizing gear 6 and the gear 10 are simultaneously released.

In the third example, the bearing hole 15B is an arcuate slot which is formed along the circle that is concentric with the gear 10. When the rotation of the gear 10 is abruptly stopped in this case, the gear 7 is pushed down by the energizing gear 6 and the idle gear shaft 9 is moved within the bearing hole 15B in the direction remote from the above imaginary line. By this action, the engagement between the energizing gear 6 and the gear 7 is released, while the gear 10 and the idle gear 8 are kept engaged with each other. In order to allow the idle gear shaft 9 to move within the bearing hole 15, the bearing hole of the shaft 9 on the other side (not shown) must be provided with some play.

Therefore, when the wheels 1 are forcibly stopped or reversely rotated during the energized state of the fly-wheel 4, the engagement between the idle gear 8 and the gear 10 or the energizing gear 6 and the gear 7 can be released, so that the damage of gears can be avoided. When the turning torque of the fly-wheel 4 becomes weak, the force of the energizing gear 6 to push the gear 7 forward also becomes weak, so that the idle gear shaft 9 is pushed back by the force of spring 16 and the idle gear 8 and the gear 10 or the energizing gear 6 and the gear 7 are engaged together. In this action, the resistance between the idle gear 8 and the gear 10 or between the energizing gear 6 and the gear 7, has become small so that the gears can be prevented from wearing or damaging.

Further, when the energizing gear 6 is omitted and the idle gear 9 is directly provided with the fly-wheel 4, the engagement between the idle gear 8 and the gear 10 can be released if resistance is applied between the idle gear 8 and the gear 10, and the idle gear shaft 9 is moved in the bearing hole 15. In this case, the bearing hole 15 may be so formed that the idle gear shaft 9 can be moved away from the gear shaft 11 so as to disengage the idle gear 8 from the gear 10. By the way, the spring 16 is not restricted to the one shown in the drawing. For example, the idle gear shaft 9 may be pulled toward the imaginary line by means of a helical spring that is attached to one end of the gear box 13.

The second embodiment of the present invention having a gear changing mechanism in the gear train will be described in the following. In this embodiment, the gear disengaging mechanism of the foregoing first embodiment is brought into engagement with other gear of different gear ratio.

Figure 4:
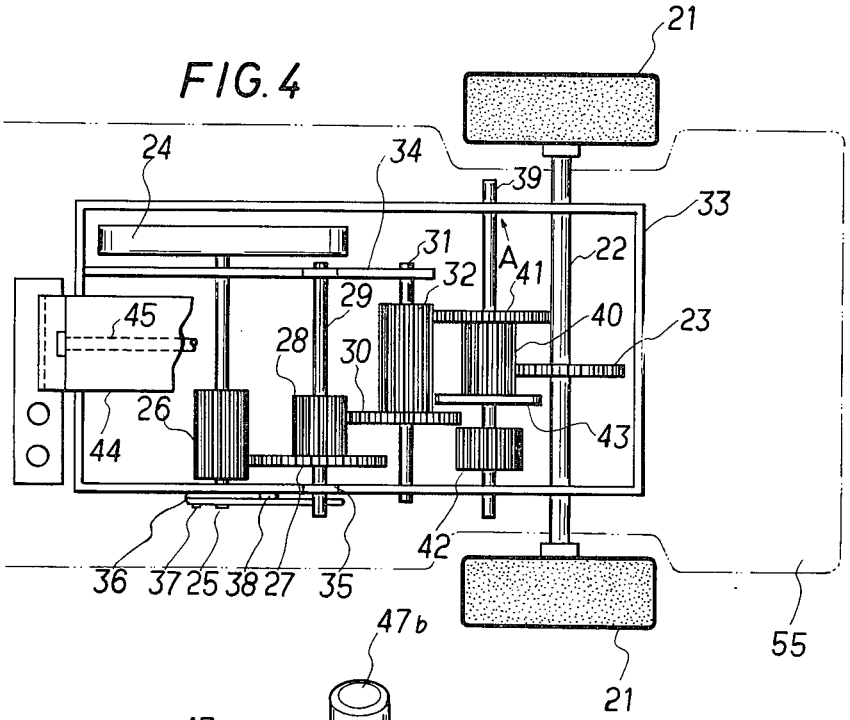
FIG. 4 is a plan view of the main portion of the gear changing mechanism with the gear disengaging mechanism.

FIG. 4 shows the plan view of the gear changing mechanism in the second embodiment that is provided with the gear releasing mechanism.

The reference numeral 21 indicates wheels which are attached to a driving shaft 22. A driving gear 23 is fixed to the driving shaft 22. The fly-wheel indicated by the reference numeral 24 is attached to a wheel shaft 25 which is provided with an energizing gear 26. This energizing gear 26 is meshed with a gear 27 on an idle gear shaft 29 having another idle gear 28. This idle gear 28 is engaged with a gear 30 which is attached to a gear shaft 31 together with a gear 32. The reference numeral 33 is a gear box and the numeral 34, an inner gear box.

Figure 6:
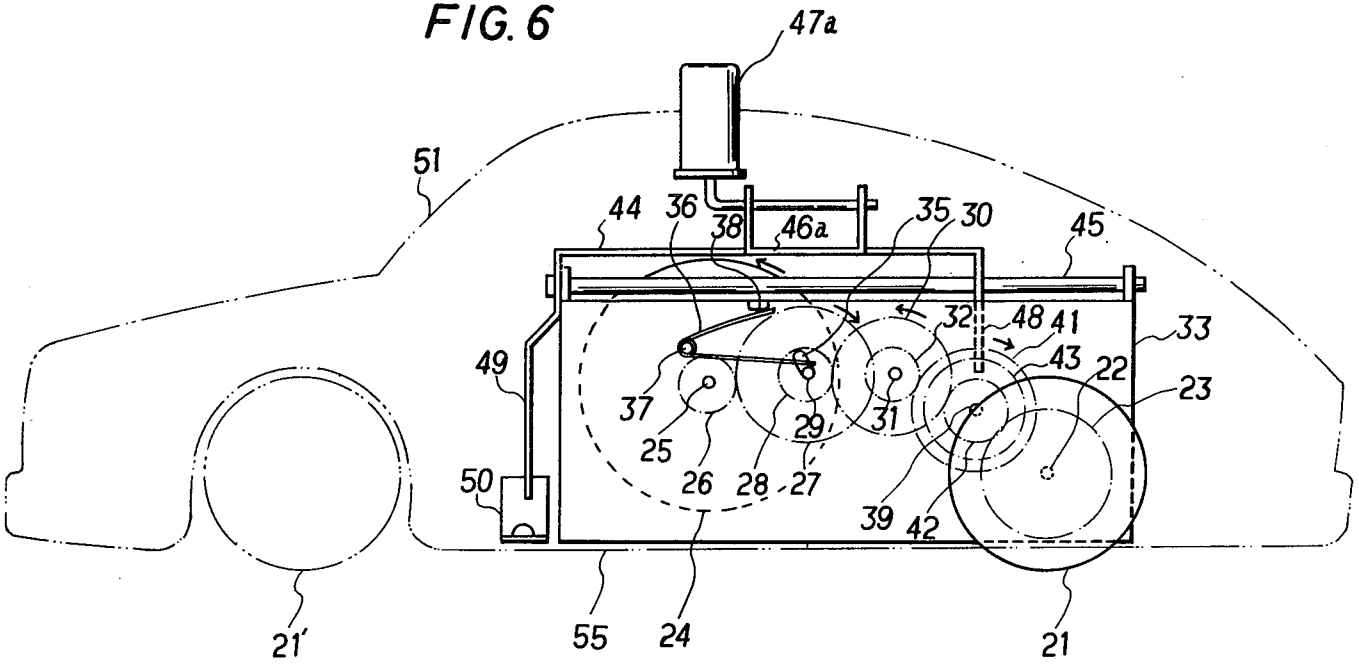
FIG. 6 is a side view of the combination of the mechanisms shown in FIGS. 4 and 5.

In the side elevation of FIG. 6 showing the whole of the gear changing mechanism having the automatic gear releasing mechanism, the bearing hole 35 for the idle gear shaft 29 is clearly indicated as a slot. The foregoing description on the position and direction of the bearing hole 15 in the first embodiment can be applied to this slot-shaped bearing hole 35, so that the detailed description thereon is omitted here.

The idle gear shaft 29 is depressed by a spring 36 that is supported by a spring shaft 37. In this state, the idle gear 28 and the gear 30 are engaged together. After the fly-wheel 24 is rotated counter-clockwise, however, if the gear 30 is forcibly stopped, the idle gear shaft 29 is shifted up within the bearing hole 35 by the rotation of the energizing gear 26 that is turned by the inertia of the fly-wheel 24. The distance between the gear shaft 31 and the idle gear shaft 29 is thus enlarged and the engagement between the idle gear 28 and the gear 30 becomes incomplete, therefore, the idle gear 28 is idly rotated. When the rotation of the fly-wheel 24 becomes slow, the idle gear shaft 29 is moved down again since the force of the gear 27 to push up the energizing gear 26 becomes weak, so that the idle gear 28 comes into engagement with the gear 30.

The reference numeral 39 indicates a sliding shaft which is slid along its axis. To this sliding shaft 39 are attached a gear 40 which is engaged with the driving gear 23, a change gear 41 which is engaged with a gear 32, and a change gear 42 which is engaged with a gear 30. The engagement between the gear 32 and the change gear 41, and between the gear 30 and the change gear 42 is selective. That is, the gear 32 and the change gear 41 are engaged together in FIG. 4, however, when the sliding shaft 39 is moved in the direction of an arrow A', the above gears are disengaged and the gear 30 and the change gear 42 are engaged together. By the way, the numbers of teeth of the change gears 41 and 42 are different from each other. It will be apparent that the speed change effect with the sliding of the sliding shaft 39 is owing to the difference of gear ratios.

The gear changing operation of the above-described gear changing mechanism will be disclosed in the following.

Figure 5:
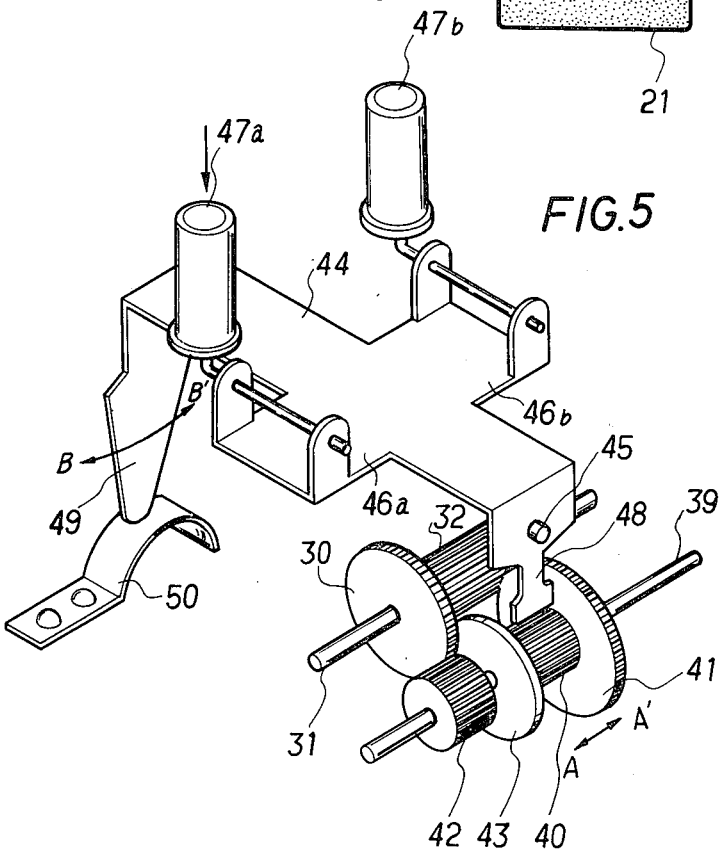
FIG. 5 is a perspective view of the gear change operation mechanism.

In FIG. 5, the reference numeral 43 indicates a flange which is attached to the sliding shaft 39. The reference numeral 44 denotes a rocking plate which is rocked about a supporting shaft 45 as a fulcrum. The supporting shaft 45 is pivoted to the gear box at right angles to the sliding shaft 39. A pair of rocking arms **46*a* and 46*b* are attached to both side of the rocking plate 44 and the rocking arms 46*a* and 46*b* are respectively provided with push-buttons 47*a* and 47*b* at their free ends. The push-buttons 47*a* and 47*b* are pivotally supported so as to be held always vertically. A working arm 48 is formed on the center line of the rocking plate 44, in which the arm 48 is extended downward into the space between the change gear 41 and the flange 43. The reference numeral 49 indicates a leg piece which extends also downward from the rocking plate 44 and is always urged in one direction by an inverted J-shaped leaf spring 50. When a push-button 47*a* is depressed, the leg piece 49 moves up along the left slope of the spring 50 and, passing over the top of the raised portion, it reaches the side of B' which is the reverse of the state in FIG. 5. Thus, the rocking plate 44 is inclined about the fulcrum of the supporting shaft 45 in the direction to lower the rocking arm 46*a* and the working arm 48 is simultaneously turned to push the side wall of the change gear 41. Therefore, the sliding shaft 39 is slid in the direction of the arrow A'. Accordingly, the engagement between the gear 32 and the change gear 41 is released and, at the same time, the gear 30 and the change gear 42** are brought into engagement together. With the above operation, the gear ratio is made large so that the toy car is accelerated.

When the push-button **47*b* is then pushed, the leg piece 49 moves up the right slope of the spring 50 and reaches the side of the arrow B by way of the top portion of the raised part of the spring 50. Thus, the rocking plate 44 is turned about the fulcrum of the supporting shaft 45 and the rocking arm 46*b* is lowered. While, the working arm 48 pushes the side wall of the flange 43 and the sliding shaft 39 is slid in the direction of the arrow A. Therefore, the engagement between the gear 30 and the change gear 42 is released and the gear 32 and the change gear 41 are brought into engagement with each other, thus the gear ratio is reduced and the toy car is driven at a low speed. Incidentally, FIG. 5 shows the state in which the push-button 47*b*** is depressed.

Figure 7:
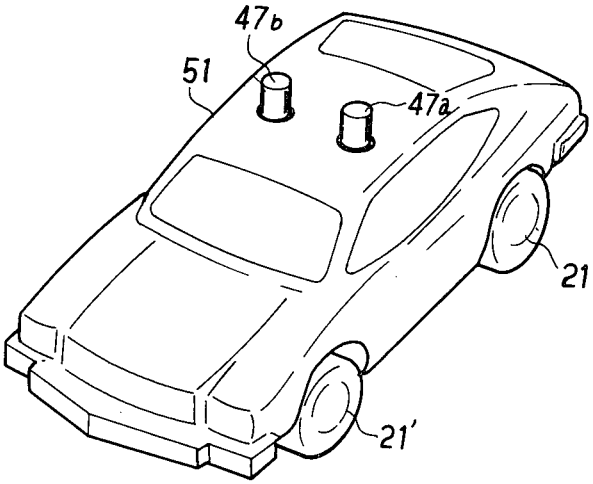
FIG. 7 is a perspective view of the outside of the device shown in FIG. 6.

It is convenient that the push-buttons **47*a* and 47*b* for the changeover operation are protruded from the upper portion of the car body. For this purpose, two apertures are defined in the upper surface of the car body 51 and the push-buttons 47*a* and 47*b* are thrust out through the apertures as shown in FIG. 7**.

As described in the above, when a gear changing means is installed between the driving section and the follower section, it becomes possible to change the speed to two steps of high and low speeds. Thus, children feel much interest in such toy car. Further, since the toy is provided with the automatic gear releasing mechanism which makes the fly-wheel idle when the toy is suddenly stopped by pressing the wheels, the gears are prevented from damage and the toy can be used for long time. Incidentally, the reference numeral 55 denotes a chassis of the toy car and the driving shaft 22 for the wheels 21 is attached to the chassis 55. Further, the gear box 33 and the inner gear box 34 are vertically attached also to the chasis 55.

In the above-described embodiments, the driving section is exemplified by the fly-wheel, however, the driving section is by no means restricted to the fly-wheel, but electric motors and springs are likewise used.

With regard to other mechanisms, although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. A movable toy having a gear disengaging mechanism which comprises: a first gear which is rotated by a driving section, a third gear which transmits the rotation to wheels, a second gear which is disposed between said first gear and said third gear, and a slot-shaped bearing hole for supporting the shaft of said second gear which is disposed on the outside of the imaginary line defined by connecting the shafts of said first gear and said third gear, in which the shaft of said second gear is urged toward said imaginary line by a spring so as to engage said second gear with said third gear, and when said third gear is forcibly stopped in relation to said first gear rotating in a certain direction, the shaft of said second gear is shifted in said bearing hole by the rotation of said first gear in the direction remote from said imaginary line against the force of said spring, thereby releasing the engagement between said second gear and said third gear.

2. A movable toy having a gear disengaging mechanism as claimed in claim 1, wherein said bearing hole is a slot which is defined on a part of the circumference of a concentric circle about the center of said first gear.

3. A movable toy having a gear disengaging mechanism as claimed in claim 1, wherein said bearing hole is a slot which is defined on a part of the circumference of a concentric circle about the center of said third gear.

4. A movable toy having a gear disengaging mechanism as claimed in claim 1, wherein said bearing hole is a slot which is defined in right angles to the imaginary line between said first gear and said third gear.

5. A movable toy having a gear changing mechanism which comprises: a gear which is in engagement with the gear attached to the wheel shaft in a driven section, a sliding shaft which carries the former gear, a group of gears which receives the rotation from a driving section by engaging with the gear on said sliding shaft when said sliding shaft is slid in one direction, the other group of gears which receives the rotation from said driving section by engaging with the gear on said sliding shaft when said sliding shaft is slid in the other direction, the gear ratio of the latter group of gears being different from that of the former group of gears, a rocking plate which is supported by a supporting shaft and slides said sliding shaft, and a pair of push-buttons which rock said rocking plate; in which, when a push-button on one side is depressed, said rocking plate is rocked in one direction about the fulcrum of said supporting shaft, said sliding shaft is thus slid in one direction and the gear on said sliding shaft is engaged with one of said groups of gears, and when the other push-button is depressed, said rocking plate is rocked in the other direction about the fulcrum of said supporting shaft, said sliding shaft is slid in the other direction and the gear on said sliding shaft is engaged with the other group of gears.

6. A movable toy having a gear changing mechanism as claimed in claim 5, wherein the bearing hole for an intermediate gear is a slot which is defined on the outside of the imaginary line between the shafts of a front stage gear and a rear stage gear, said intermediate gear being disposed between a driving section and a driven section so as to transmit the rotation of said driving section to the wheel shaft in said driven section and the intermediate gear shaft being urged toward said imaginary line so as to bring said front stage gear and said rear stage gear into engagement with each other, and when the rear stage gear is forcibly stopped in relation to said front stage gear rotating in a certain direction, said intermediate gear shaft is shifted in said bearing hole by the rotation of said front stage gear in the direction remote from said imaginary line against the force of said spring, thereby releasing the engagement between said front stage gear and said rear stage gear.

7. A fly-wheel type movable toy as claimed in claim 5 which is provided with said rocking plate pivotally secured to said supporting shaft that is disposed at right angles to said sliding shaft, a working arm which is extended downward from said rocking plate so as to engage with a flange being attached to said sliding shaft, a leg piece which is extended downward from said rocking plate, an inverted J-shaped spring supporting said leg piece on one side thereof with pressure, and push buttons which are attached to arm portions on both sides of said rocking plate and partially protruded from the upper portion of the car body; and when one of said push-button is depressed, said rocking plate is turned, said leg piece is slid to the other side passing over the raised portion of said spring and said sliding shaft is slid in the direction of the rocking, thereby attaining the changeover of gears.

* * * * *